US010116060B2

(12) United States Patent
Cole et al.

(10) Patent No.: US 10,116,060 B2
(45) Date of Patent: Oct. 30, 2018

(54) VARIABLE BEAM WIDTH ANTENNA SYSTEMS

(71) Applicant: CommScope Technologies LLC, Hickory, NC (US)

(72) Inventors: Douglas John Cole, Powmill (GB); Claudio Biancotto, Edinburgh (GB); Craig Mitchelson, Cumbernauld (GB)

(73) Assignee: CommScope Technologies LLC, Hickory, NC (US)

( * ) Notice: Subject to any disclaimer, the term of this patent is extended or adjusted under 35 U.S.C. 154(b) by 111 days.

(21) Appl. No.: 15/241,124

(22) Filed: Aug. 19, 2016

(65) Prior Publication Data

US 2017/0062946 A1 Mar. 2, 2017

Related U.S. Application Data

(60) Provisional application No. 62/212,184, filed on Aug. 31, 2015.

(51) Int. Cl.

| | |
|---|---|
| ***H01Q 21/24*** | (2006.01) |
| ***H01Q 15/14*** | (2006.01) |
| ***H01Q 3/01*** | (2006.01) |
| ***H01Q 3/14*** | (2006.01) |
| ***H01Q 3/20*** | (2006.01) |
| ***H01Q 3/24*** | (2006.01) |
| ***H01Q 3/26*** | (2006.01) |

(Continued)

(52) U.S. Cl.

CPC ..... *H01Q 15/14* (2013.01); *H01Q 3/01* (2013.01); *H01Q 3/14* (2013.01); *H01Q 3/20* (2013.01); *H01Q 3/247* (2013.01); *H01Q 3/26* (2013.01); *H01Q 15/02* (2013.01); *H01Q 15/161* (2013.01); *H01Q 15/165* (2013.01); *H01Q 15/242* (2013.01); *H01Q 17/00* (2013.01); *H01Q 21/24* (2013.01); *H01Q 25/002* (2013.01); *H01Q 1/1257* (2013.01); *H01Q 3/00* (2013.01)

(58) Field of Classification Search

CPC ..... H01Q 15/14; H01Q 21/24

See application file for complete search history.

(56) References Cited

U.S. PATENT DOCUMENTS 3,364,490 A 1/1968 Hannan
3,413,637 A 11/1968 Goebels et al.

(Continued)

FOREIGN PATENT DOCUMENTS

WO WO 2013/023226 A1 2/2013

OTHER PUBLICATIONS

Extended Search Report corresponding to EP Application No. 16185416.1, dated Jun. 14, 2017, 19 pages.

(Continued)

*Primary Examiner* — Hoang Nguyen
*Assistant Examiner* — Awat Salih
(74) *Attorney, Agent, or Firm* — Myers Bigel, P.A.

(57) ABSTRACT

A microwave antenna is operated in a first operating state during an alignment operation for the microwave antenna system where the microwave antenna is configured to have a first beam width. Subsequent to the alignment operation, the microwave antenna is operated in a second operating state where the beam of the microwave antenna is configured to have a second beam width that is narrower than the first beam width.

9 Claims, 13 Drawing Sheets

(51) Int. Cl.

| | |
|---|---|
| ***H01Q 15/02*** | (2006.01) |
| ***H01Q 15/16*** | (2006.01) |
| ***H01Q 15/24*** | (2006.01) |
| ***H01Q 17/00*** | (2006.01) |
| ***H01Q 25/00*** | (2006.01) |
| *H01Q 1/12* | (2006.01) |
| *H01Q 3/00* | (2006.01) |

(56) References Cited

U.S. PATENT DOCUMENTS

| | | | | |
|---|---|---|---|---|
| 3,866,233 | A | 2/1975 | Schmidt | |
| 5,929,808 | A | 7/1999 | Hassan et al. | |
| 2008/0309569 | A1* | 12/2008 | Berejik | H01Q 1/185 343/761 |
| 2008/0315944 | A1* | 12/2008 | Brown | H03F 3/24 330/5 |
| 2011/0199252 | A1 | 8/2011 | Klar et al. | |
| 2012/0068880 | A1 | 3/2012 | Kullstam | |
| 2013/0082896 | A1* | 4/2013 | Renilson | H01Q 15/16 343/872 |

OTHER PUBLICATIONS

Extended Search Report corresponding to EP Application No. 16185416.1, dated Feb. 1, 2017, 11 pages.

* cited by examiner

10

VARIABLE BEAM WIDTH ANTENNA SYSTEMS

CROSS-REFERENCE TO RELATED APPLICATION

This application claims priority under 35 U.S.C. § 119 from U.S. Provisional Patent Application Ser. No. 62/212,184, filed on Aug. 31, 2015, the disclosure of which is hereby incorporated by reference herein as if set forth in its entirety.

BACKGROUND

The present application relates to antenna systems and, more particularly, although not exclusively, to microwave antenna systems that have beam widths that may be varied.

Microwave antennas are used for transmission and reception of microwave electromagnetic-radiation signals. A microwave antenna will have a particular characteristic beam pattern. This beam pattern typically includes a main lobe. The dimensions of the main lobe define the beam width for the principle transmission/reception beam for the antenna. A typical beam pattern also includes a number of side lobes. These side lobes reduce the transmission efficiency (as they typically represent lost signal power), but generally do not significantly impact alignment of the microwave antenna. The beam width of the main lobe—which is typically measured in terms of the angle subtended by the main lobe—is inversely proportional to the frequency of the signals transmitted by the antenna and to the effective size of the antenna. In other words, (a) the higher the operating frequency, the narrower the beam width, and (b) the larger the antenna, the narrower the beam width.

A microwave transmission link comprises a pair of distant antennas, namely a first antenna that transmits a microwave signal and a second antenna that receives the microwave signal. A thin—in other words, narrow or pencil—beam between the two antennas is more useful than a fat—in other words, wide—beam for efficiently transmitting signals between those two antennas since much more of the signal energy is directed from the transmitter to the receiver with a thin beam than with a fat beam. When setting up the two antennas for the transmission link, however, using a thin beam is more challenging than using a fat beam for alignment of the boresights of the respective antennas since a thin beam is more difficult to acquire and pinpoint than a fat beam.

SUMMARY

Pursuant to embodiments of the present invention, methods of operating microwave antenna systems that include a microwave antenna are provided. Pursuant to these methods, the microwave antenna is operated in a first operating state during an alignment operation for the microwave antenna system where the microwave antenna is configured to have a first beam width. Subsequent to the alignment operation, the microwave antenna is operated in a second operating state where the microwave antenna is configured to have a second beam width that is narrower than the first beam width.

In some embodiments, the microwave antenna may comprise a flat panel array that has a plurality of antenna elements. A first subset of the antenna elements are used when the microwave antenna is operating in the first operating state and a second subset of the antenna elements are used when the microwave antenna is operating in the second operating state. The second subset of the antenna elements includes more antenna elements than the first subset of the antenna elements. For example, the second subset of the antenna elements may include all of the antenna elements.

In some embodiments, the microwave antenna may comprise a central reflector and the microwave antenna system may comprise the central reflector and a ring that circumferentially surrounds the central reflector. The first beam width may correspond to a beam width of a beam formed by the central reflector, and the second beam width may correspond to a beam width of a beam formed by the combination of the central reflector and the ring. The ring may comprise, for example, a plurality of petals that extend radially outwardly from the central reflector. The petals may be foldable petals. The ring may be removably attached to the central reflector.

In some embodiments, the microwave antenna may comprise a reflector antenna and the microwave antenna system may comprise the reflector antenna and a polarizer that has a polarization region and a central opening. The polarization region of the polarizer may be configured to pass signals having a first polarization and may be configured to block signals having a second polarization that is orthogonal to the first polarization. A first signal that is transmitted through the microwave antenna during operation in the first operating state may have the second polarization. Consequently, the first beam width may correspond to a beam width of a signal transmitted through the central opening of the polarizer. A second signal that is transmitted through the microwave antenna during operation in the second operating state may have the first polarization. The polarizer may be a removable polarizer or a rotatable polarizer.

In some embodiments, a pointing direction of the microwave antenna while operating in the first operating state may be the same as a pointing direction of the microwave antenna while operating in the second operating state, and a frequency of a signal transmitted in the first operating state may be the same as a frequency of a signal transmitted in the second operating state.

In some embodiments, the microwave antenna system may comprise the microwave antenna and a removable microwave lens. The removable microwave lens may be mounted on the microwave antenna when the microwave antenna is operating in the first operating state and may be removed from the microwave antenna when the microwave antenna is operating in the second operating state.

In some embodiments, the microwave antenna may comprise an elliptical reflector antenna, where the elliptical reflector antenna is positioned at a first orientation when the microwave antenna is operating in the first operating state and is positioned at a second, different, orientation when the microwave antenna is operating in the second operating state.

In some embodiments, the microwave antenna may comprise a reflector antenna, a feed and a blinker. The blinker may be placed over an end of the feed when the microwave antenna is operating in the first operating state and the blinker may be removed when the microwave antenna is operating in the second operating state.

In some embodiments, the microwave antenna may comprise a reflector antenna having a movable feed system, where the movable feed system is at a first position when the microwave antenna is operating in the first operating state and is at a second, different, position when the microwave antenna is operating in the second operating state.

In some embodiments, the microwave antenna may comprise a reflector antenna having a waveguide tube that has a mouth and a sub-reflector, where the sub-reflector is positioned away from the mouth when the microwave antenna is operating in the first operating state and is positioned atop the mouth when the microwave antenna is operating in the second operating state.

Pursuant to further embodiments of the present invention, methods of operating microwave antenna systems are provided. Pursuant to these methods, a microwave antenna is used to generate a first antenna beam having a first beam width when the microwave antenna system is operating in a first operating state, and the microwave antenna is used to generate a second antenna beam having a second beam width when the microwave antenna is operating in a second operating state. The second beam width is narrower than the first beam width.

In some embodiments, a pointing direction of the microwave antenna while operating in the first operating state may be the same as a pointing direction of the microwave antenna while operating in the second operating state, and a frequency of a signal transmitted in the first operating state may be the same as a frequency of a signal transmitted in the second operating state. In some embodiments, the microwave antenna may comprise a reflector antenna and one of a polarizer having a central opening, a microwave lens, a ring that circumferentially surrounds the reflector antenna, a laterally movable feed, a feed with a removable blinker or a feed with a removable or repositionable sub-reflector. In other embodiments, the microwave antenna may comprise a flat panel array having a plurality of antenna elements, and a first subset of the antenna elements are used when the microwave antenna is operating in the first operating state and a second subset of the antenna elements are used when the microwave antenna is operating in the second operating state, where the second subset of the antenna elements includes more antenna elements than the first subset of the antenna elements.

Pursuant to still further embodiments of the present invention, microwave antenna systems are provided that include a microwave antenna that is configured to have a first aperture size when operating in a first operating state during an alignment operation for the microwave antenna system and a second aperture size when operating in a second operating state subsequent to completion of the alignment operation, where the second aperture size exceeds the first aperture size.

DETAILED DESCRIPTION

Pursuant to embodiments of the present invention, microwave antenna systems are provided that can operate in at least first and second operating states where the microwave antenna has different beam widths. When operating in the first operating state, the microwave antenna system may be configured so that a microwave antenna thereof will have a relatively wide beam width. The microwave antenna may be operating in the first operating state when the microwave antenna is being physically aligned to point at a distant antenna. The use of the wider beam width antenna beam may make it easier to align the antenna to point at the distant antenna. Once the antenna is properly aligned to point in a desired direction, the microwave antenna may be configured to operate in the second operating state that has the narrower beam width. The narrower beam width may have a higher gain and hence provide for improved transmission efficiency.

An antenna whose beam width may be varied allows the use of (i) a wider beam during the setup or reconfiguration of a communication link to align the boresights of the respective antennas and (ii) a narrower beam during normal operation, after the setup, for more-efficient signal transmission. Typically, the active radio device that generates the signals that are fed to the microwave antenna for transmission operates at a fixed frequency. Consequently, the exemplary embodiments described below vary the beam width by varying the actual or effective size of the antenna while keeping the operating frequency fixed.

Figure 1:
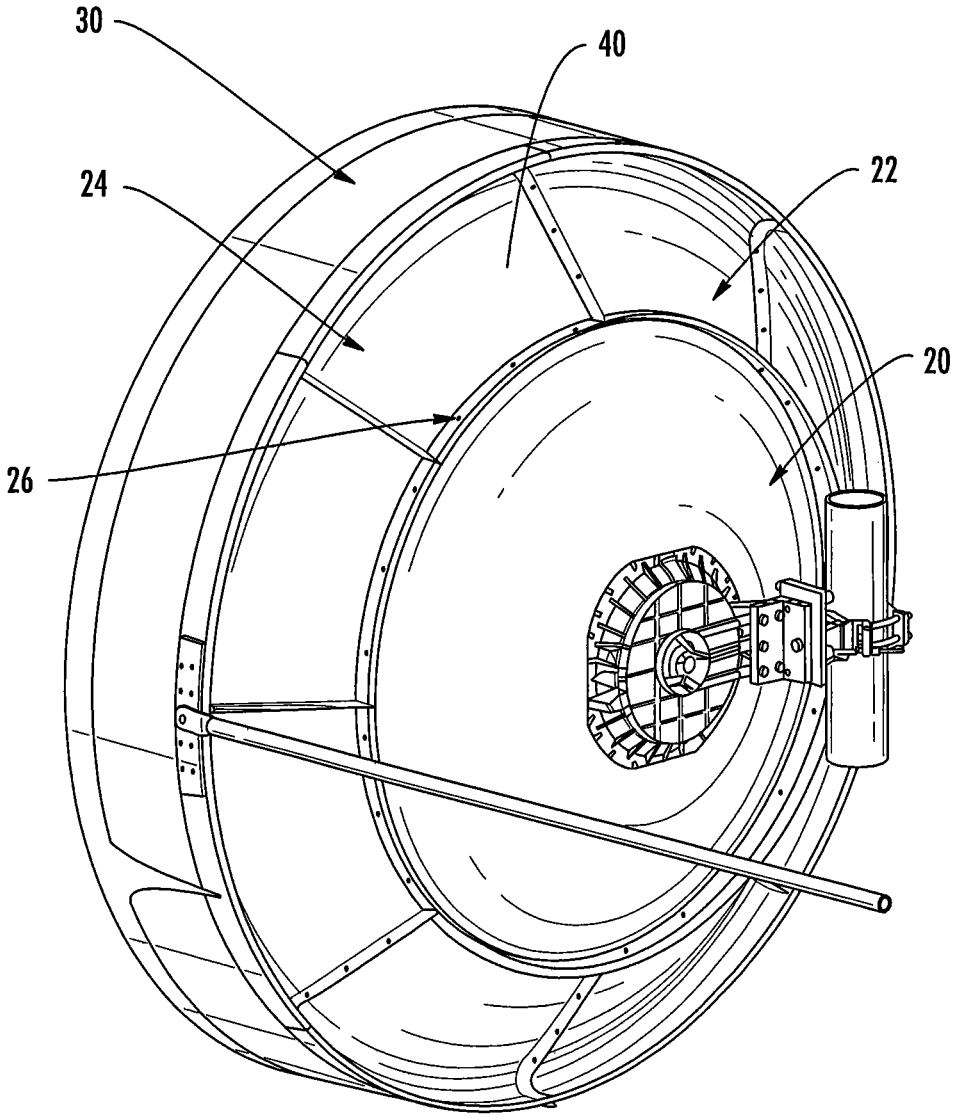
FIG. 1 is a rear perspective view of a microwave antenna system according to embodiments of the present invention that includes a central reflector and a ring of foldable/removable petals that surround the central reflector.

FIG. 1 is a perspective view of the back side of a microwave antenna system 10 in accordance with one embodiment of the disclosure. Microwave antenna system 10 comprises a central reflector 20, a plurality of reflector petals 24, and an optional, cylindrical shield 30. Each reflector petal 24 is attached to the perimeter 22 of central reflector 20 by a hinge 26 or a similar attachment mechanism that allows petal 24 to be folded backwards in direction 40. During regular operation, the reflector petals 24 are in a deployed position and, together with central reflector 20, form one large reflector dish. During alignment, however, the shield 30 is not yet installed (or, if already installed, is removed) and the petals 24 are set in a stowed position where the petals 24 are folded backwards. Consequently, the effective antenna area of microwave antenna system 10 is limited to the area of central reflector 20. As a result, the beam width when the petals 24 are in the stowed position is wider than the beam width when the petals 24 are in the deployed position.

In an alternative implementation, the petals 24 are removably connected to the central reflector 20 with fasteners that allow for the rapid removal and re-attachment of the petals 24 to the central reflector 20. In another alternative implementation, microwave antenna system 10 is aligned with a distant antenna with only the central reflector 20 in place and, subsequently, the petals 24 are fixedly or removably attached to the central reflector 20 for regular operation. Fixed attachment refers to an attachment that does not allow for a rapid removal—for example, using screws, bolts, glue, or solder. In another alternative implementation, the entire ring formed by all of the petals 24 together is removably attached, as a unitary ring, to the central reflector 20. In such embodiments, the ring may be a monolithic structure as opposed to a plurality of petals 24 that are attached together to form the unitary ring.

Figure 2A:
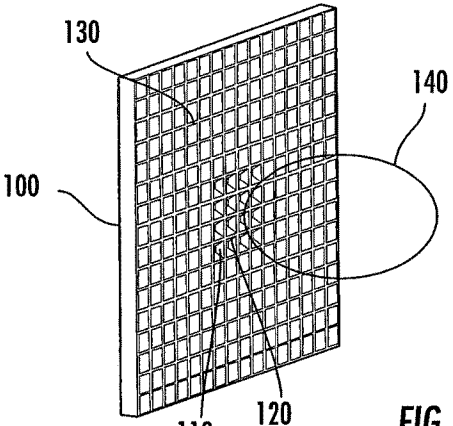
FIG. 2A is a front perspective view of a flat panel microwave antenna system operating in a first operating state in which the microwave antenna has a relatively wide beam width.
Figure 2B:
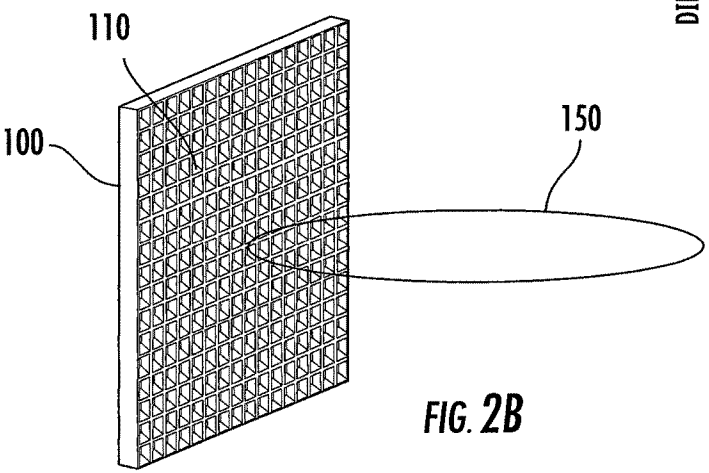
FIG. 2B is a front perspective view of the flat panel microwave antenna system of FIG. 2A operating in a second operating state in which the microwave antenna has a narrower beam width.
Figure 2C:
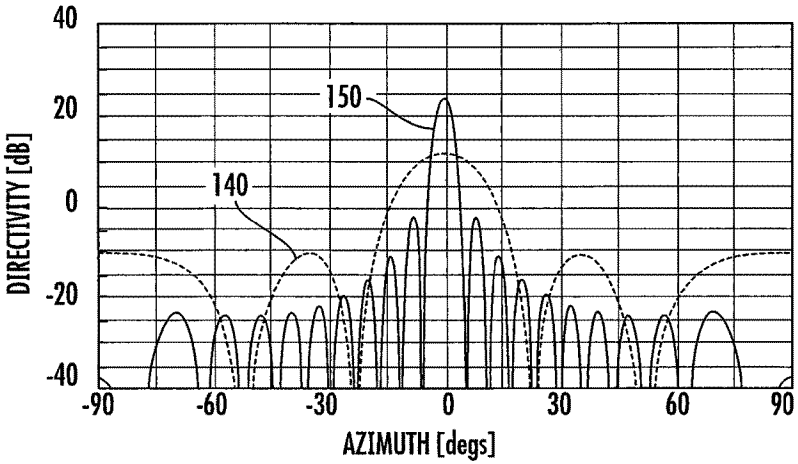
FIG. 2C is an azimuth signal strength graph illustrating the signal strength of signals transmitted by the microwave antenna system of FIGS. 2A and 2B as a function of azimuth angle when operating in the respective first and second operating states.

FIG. 2A is a perspective view of a microwave antenna system 100 operating in a first state in accordance with another embodiment of the disclosure. FIG. 2B is a perspective view of the antenna 100 of FIG. 2A operating in a second state. FIG. 2C is an azimuth signal strength graph for the signals produced by microwave antenna system 100 in the first and second operating states of FIGS. 2A and 2B, respectively.

Microwave antenna system 100 is a flat-panel antenna comprising a 16×16 array of antenna elements 110. In the first operating state, shown in FIG. 2A, and which may be used for alignment of microwave antenna system 100, only the 4×4 central subarray 120 of the antenna elements 110 are active, while the remaining 240 elements 110 in peripheral subarray 130 are inactive. In the first operating state, microwave antenna system 100 generates beam 140, which has a relatively wide beam width. In the second operating state, shown in FIG. 2B, and which may be used for regular operation of microwave antenna system 100, all of the antenna elements 110 are active. In the second operating state, microwave antenna system 100 generates beam 150, which has a relatively narrow beam width. Note that wide beam 140 and narrow beam 150 have the same spatial orientation; in other words, both are pointing in the same direction.

The antenna array may have more or fewer than 256 elements and the sub-array may have fewer or more than 16 elements. Further note that the flat-panel antenna is not limited to a square shape and may be any other suitable shape, including, for example, triangle, rectangle, pentagon, hexagon, octagon, and circle.

In an alternative implementation, some antenna elements 110 may be inactive in the second operating state as long as more antenna elements 110 are active in the second operating state than are active in the first operating state. In one alternative implementation, the elements 110 of subarray 120 might not all be located substantially in the center of the array of flat panel microwave antenna system 100.

Figure 3A:
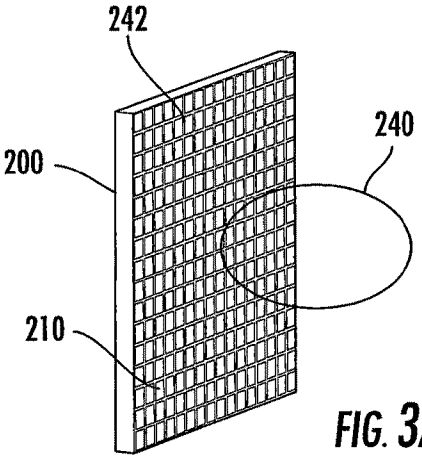
FIG. 3A is a front perspective view of a flat panel microwave antenna system operating in a first operating state in which the microwave antenna has a relatively wide beam width.
Figure 3B:
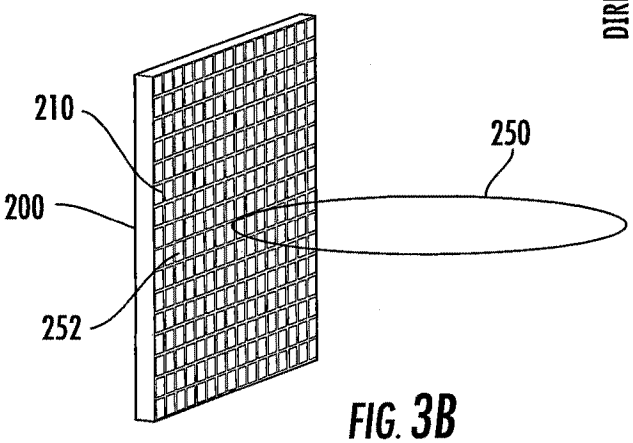
FIG. 3B is a front perspective view of the flat panel microwave antenna system of FIG. 3A operating in a second operating state in which the microwave antenna has a narrower beam width.
Figure 3C:
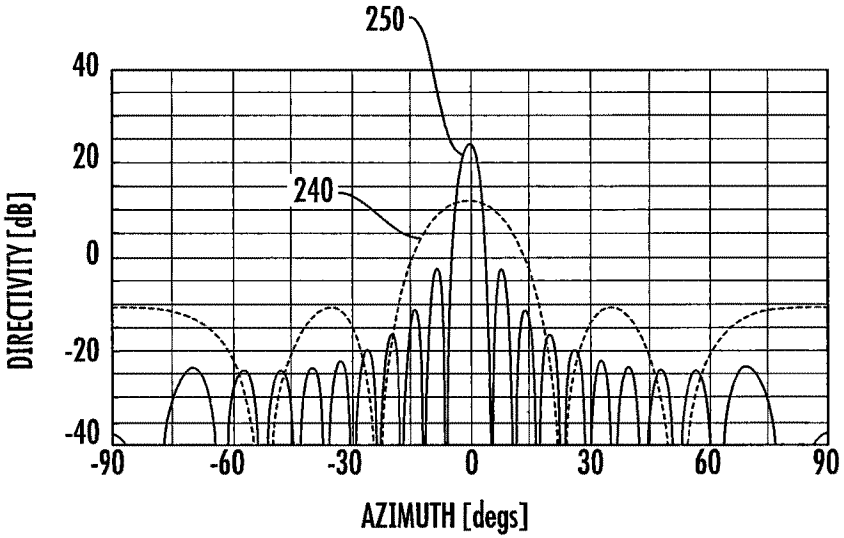
FIG. 3C is an azimuth signal strength graph illustrating the signal strength of signals transmitted by the microwave antenna system of FIGS. 3A and 3B as a function of azimuth angle when operating in the respective first and second operating states.

FIG. 3A is a perspective view of a microwave antenna system 200 operating in a first operating state in accordance with another embodiment of the disclosure. FIG. 3B is a perspective view of the microwave antenna system 200 operating in a second operating state. FIG. 3C is an azimuth signal strength graph for the signals produced by microwave antenna system 200 in the first and second operating states of FIGS. 3A and 3B, respectively.

Similar to the microwave antenna system 100 of FIGS. 2A and 2B, the microwave antenna system 200 is a flat-panel antenna comprising an array of antenna elements 210. Notably, however, elements 210 of antenna 200 have independently settable phase and/or magnitude levels. In other words, individual elements 210 may vary the phase and/or amplitude of the transmitted signal independently of the other elements 210.

In the first operating state, the microwave antenna system 200 generates beam 240, which has a relatively wide beam width, by using a suitable non-uniform excitation pattern 242—referred to as a taper pattern—for the antenna elements 210. Suitable taper patterns may, for example, include patterns in accordance with distributions such as Taylor, Dolph-Chebyshev, and Hansen. Note that the taper pattern 242 may vary (i) the phase but not the amplitude, (ii) the amplitude but not the phase, or (iii) both phase and amplitude of the elements 210.

In the second operating state, the microwave antenna system 200 generates beam 250, which has a relatively narrow beam width, by using a uniform excitation pattern 252 for the antenna elements 210. In other words, in the second operating state, all of the elements 210 transmit the signal at the same phase and amplitude. Note that the wide beam 240 and the narrow beam 250 have the same spatial orientation. Also note that the microwave antenna system 200 may have alternative implementations similar to the alternative implementations described above for the microwave antenna system 100 of FIGS. 2A and 2B.

Figure 4B:
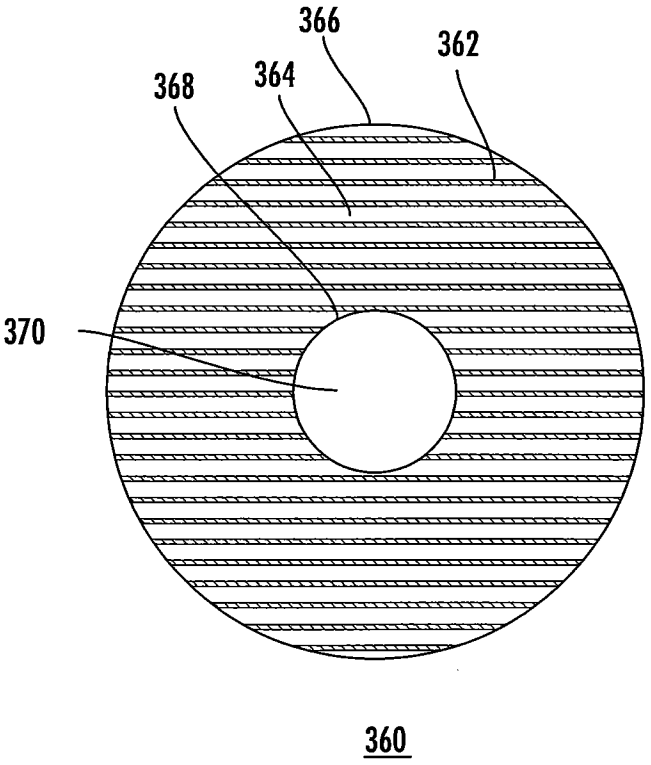
FIG. 4B is a schematic front view of the polarizing grille included in the microwave antenna system of FIG. 4A.
Figure 4A:
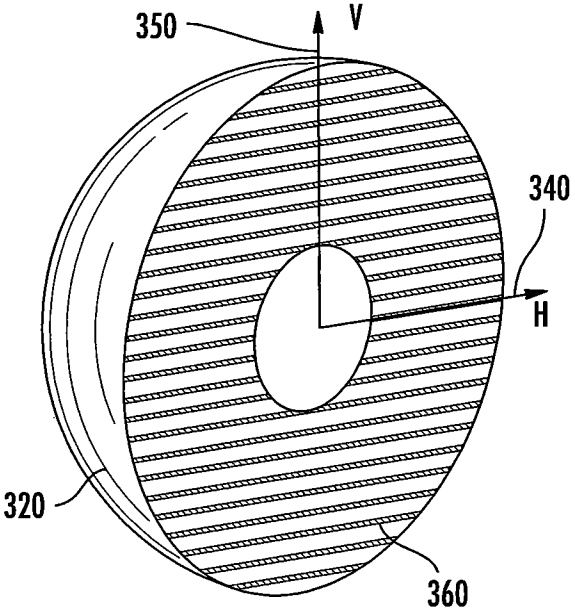
FIG. 4A is a schematic front perspective view of a microwave antenna system according to embodiments of the present invention that includes a polarizing grille.
Figure 4C:
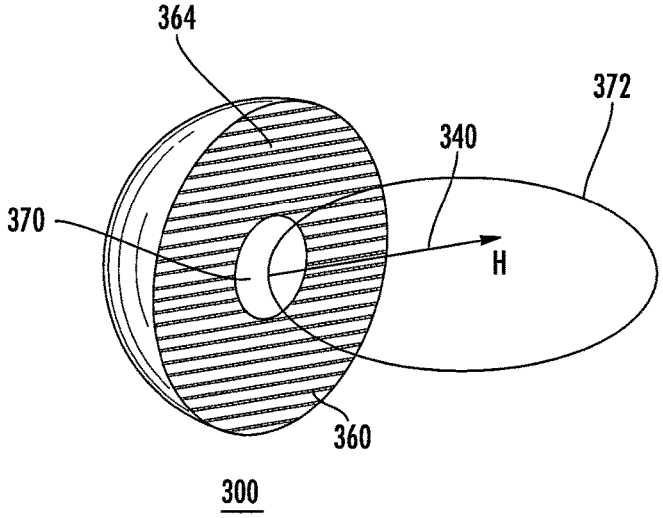
FIG. 4C is a schematic front perspective view of the microwave antenna system of FIG. 4A transmitting a horizontally polarized signal.
Figure 4D:
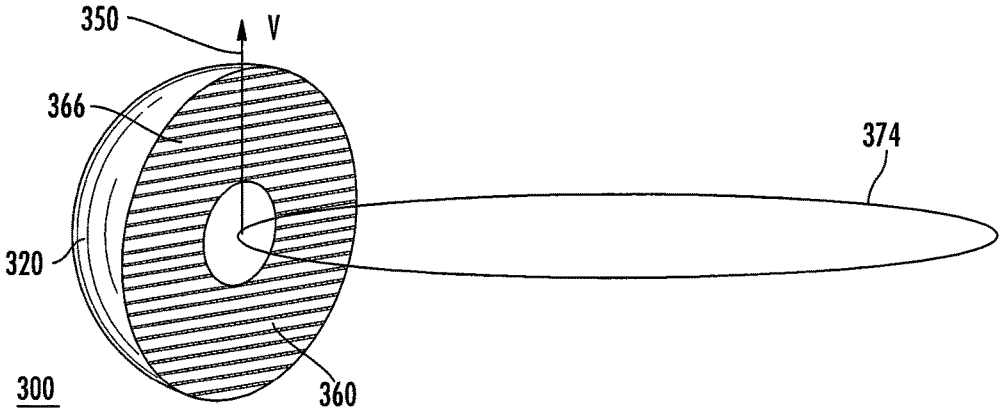
FIG. 4D is a schematic front perspective view of the microwave antenna system of FIG. 4A transmitting a vertically polarized signal.

FIG. 4A is a perspective view of a microwave antenna system 300 in accordance with another embodiment of the disclosure, where the microwave antenna system 300 comprises a reflector 320 and a polarizing grille 360. FIG. 4B is a front view of the polarizing grille 360 of FIG. 4A. FIG. 4C is a perspective view of the microwave antenna system 300 of FIG. 4A operating in a first operating state. FIG. 4D is a perspective view of the microwave antenna system 300 of FIG. 4A operating in a second operating state.

The microwave antenna system 300 is a dual-polarization antenna system adapted to transmit signals in either of two polarizations orthogonal to each other. Specifically, the microwave antenna system 300 is adapted to transmit a horizontally polarized signal 340 in a first operating state and a vertically polarized signal 350 in a second operating state. Note that the microwave antenna system 300 includes additional components (not shown) for the generation and transmission of the signals, such as, for example, a feed element.

Polarizing grille 360, a form of a wire-grid polarizer, comprises horizontal metallic lines 362 in the perimeter ring 364, which is the area between outer perimeter 366 and inner perimeter 368. Outer perimeter 366 substantially coincides with the periphery of the reflector 320. Inner perimeter 368 defines aperture 370, a metal-line-free area in the center of metal-lined ring 364. Horizontal metallic lines 362 substantially absorb, block, and/or reflect horizontally polarized electro-magnetic (EM) radiation, such as signal 340, while leaving substantially unaffected vertically polarized EM radiation, such as signal 350. Preferably, the horizontal metallic lines 362 are dimensioned and arrayed such that there are ten or more horizontal lines 362 per unit of wavelength of the signal transmitted by the microwave antenna system 300. For example, for a 10 GHz signal, whose wavelength is 3 cm, two adjacent metal lines 362 would be separated by less than a third of a centimeter.

In the first operating state, as shown in FIG. 4C, the microwave antenna system 300 generates the horizontally polarized signal 340, which is absorbed, blocked, and/or reflected by the ring 364 of the grille 360. Consequently, the effective aperture of the microwave antenna of microwave antenna system 300 is aperture 370, resulting in relatively wide beam 372. In the second operating state, as shown in FIG. 4D, the microwave antenna system 300 generates the vertically polarized signal 350, which is substantially unaffected by grille 360. Consequently, the effective aperture of the microwave antenna of microwave antenna system 300 corresponds to the area defined by outer perimeter 366, resulting in relatively narrow beam 374.

Grille 360 may be formed by any suitable means. Metal lines 362 may be, for example, printed, glued, woven, embedded or otherwise fixed in or on a fiber, paper, polymer, or any suitable microwave-permeable substrate. Aperture 370 may comprise the substrate or may be open. In an alternative implementation, metal lines 362 may be suspended in air between corresponding attachment endpoints in rings corresponding to outer perimeter 366 and/or inner perimeter 368. The supporting rings may be metallic or insulating. Preferably, the inner ring, corresponding to inner perimeter 368, is non-conductive to minimize the impact on the radiation pattern of the beams 372 and 374. In alternative embodiments, the microwave antenna system 300 may generate signals polarized in two orthogonal directions other than horizontal and vertical, where the orientation of metal lines 362 is correspondingly adjusted to be parallel to the signal in the first operating state.

Figure 5B:
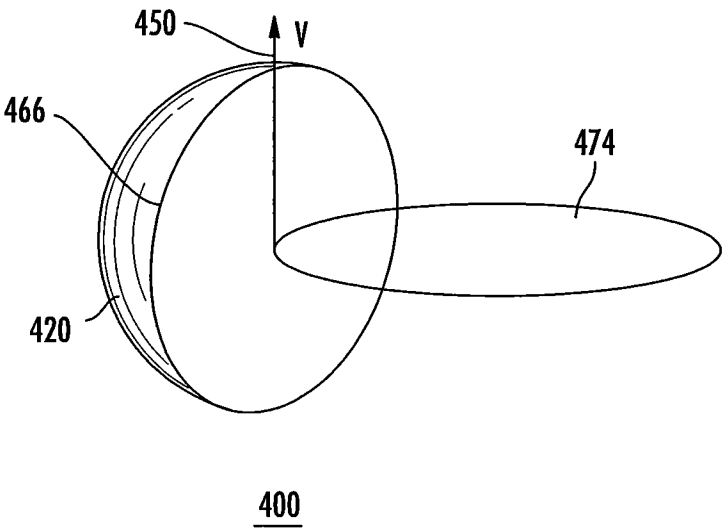
FIG. 5B is a schematic front perspective view of the microwave antenna system of FIG. 5A with the polarizing grille removed so that the microwave antenna operates in a second operating state.
Figure 5A:
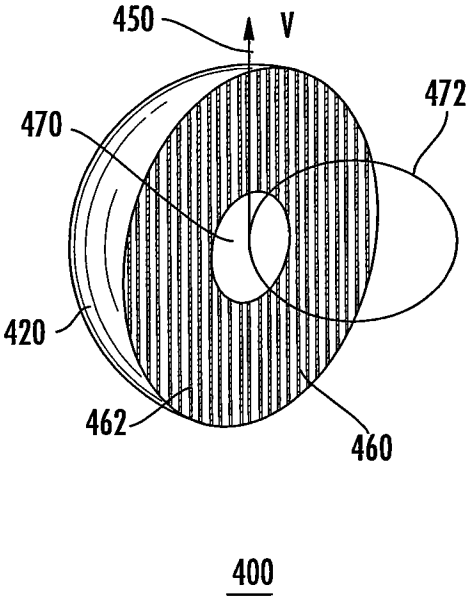
FIG. 5A is a schematic front perspective view of a microwave antenna system according to further embodiments of the present invention that includes a polarizing grille operating in a first operating state.

FIG. 5A is a perspective view of a microwave antenna system 400 in accordance with another embodiment of the disclosure, in a first operating state. FIG. 5B is a perspective view of the microwave antenna system 400 of FIG. 5A, in a second operating state. The microwave antenna system 400 comprises reflector 420 and polarizing grille 460. Antenna 400 transmits a vertically polarized signal 450. Grille 460 is substantially similar to grille 360 of FIGS. 4A-4D, except that the metallic lines 462 of grille 460 are vertical rather than horizontal.

In a first operating state, as shown in FIG. 5A, the grille 460 is situated in the opening of reflector 420. Since the metal lines 462 of the grille 460 align with the polarization of the signal 450, the effective aperture of the microwave antenna of microwave antenna system 400 is limited to the central, metal-line-free, aperture 470. Consequently, the beam width of the resultant beam 472 is relatively wide. In the second operating state, as shown in FIG. 5B, the grill 460 is removed from the opening of reflector 420. As a result, the effective aperture of the microwave antenna of microwave antenna system 400 is the perimeter 466 of the aperture of reflector 420. Consequently, the beam width of the resultant beam 474 is relatively narrow. It should be noted that, in alternative implementations, the orientations of the signal 450 and the metal lines 462 may be other than vertical, while remaining parallel to each other. In some alternative embodiments, the grille 460 may be replaced by a ring that absorbs, reflects, or otherwise blocks all microwave radiation. For example, such a ring may be made of metal or a microwave-absorbent material. In some alternative embodiments, the aperture 470 may have a shape other than a circle—such as, for example, an oval, or a polygon. In some alternative embodiments, the aperture 470 may be off-center—in other words, the aperture 470 may not be concentric with the perimeter 466.

Figure 6B:
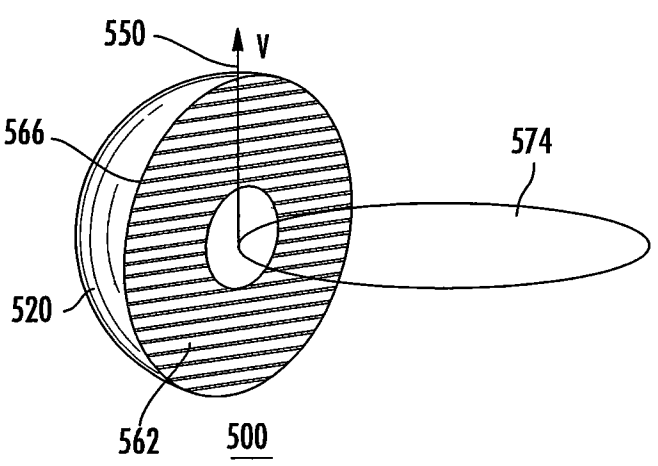
FIG. 6B is a schematic front perspective view of the microwave antenna system of FIG. 6A with the polarizing grille rotated to a different position.
Figure 6A:
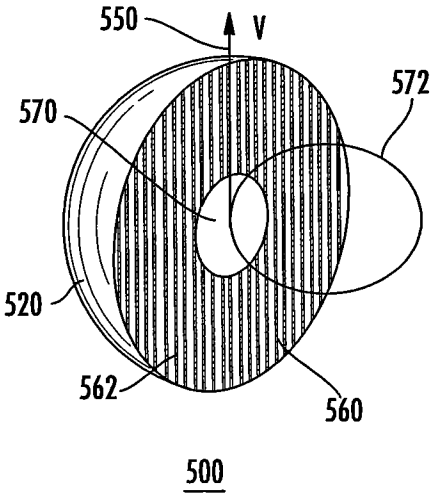
FIG. 6A is a schematic front perspective view of a microwave antenna system according to still further embodiments of the present invention that includes a rotatable/repositionable polarizing grille.

FIG. 6A is a perspective view of a microwave antenna system 500 in accordance with yet another embodiment of the disclosure, in a first operating state. FIG. 6B is a perspective view of the microwave antenna system 500 of FIG. 6A in a second operating state. The microwave antenna system 500 comprises reflector 520 and rotatable/repositionable polarizing grille 560. The microwave antenna system 500 transmits a vertically polarized signal 550. Grille 560 is substantially similar to grilles 360 of FIGS. 4A-4D and 460 of FIGS. 5A-5B, except that grille 560 is rotatable and/or repositionable.

In a first operational state, as shown in FIG. 6A, the grille 560 is positioned such that the metal lines 562 are aligned vertically, parallel to the signal 550. As a result, the effective aperture of the microwave antenna of microwave antenna system 500 is limited to metal-line-free aperture 570 in the center of grille 560. Consequently, the beam width of the resultant beam 572 is relatively wide. In the second operating state, as shown in FIG. 6B, the grille 560 is rotated and/or repositioned such that the metal lines 562 are aligned horizontally. As a result, the effective aperture of the microwave antenna of microwave antenna system 500 is the perimeter 566 of the aperture of reflector 520. Consequently, the beam width of the resultant beam 574 is relatively narrow. It should be noted that, in alternative implementations, the orientation of the signal 550 may be other than vertical, with corresponding modifications to the orientation of the grill 560 in the first and second operating states.

Figure 7B:
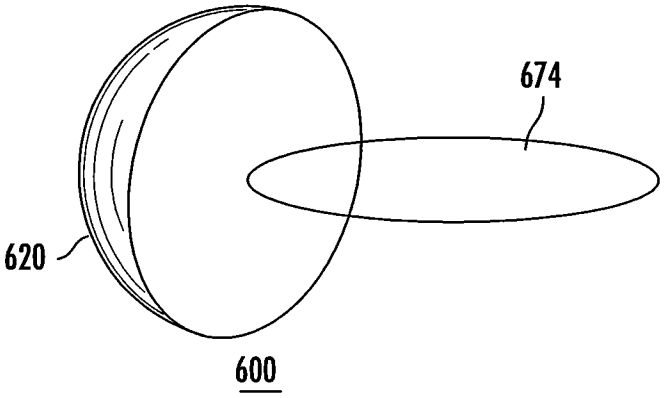
FIG. 7B is a schematic front perspective view of the microwave antenna system of FIG. 7A with the removable microwave lens removed.
Figure 7A:
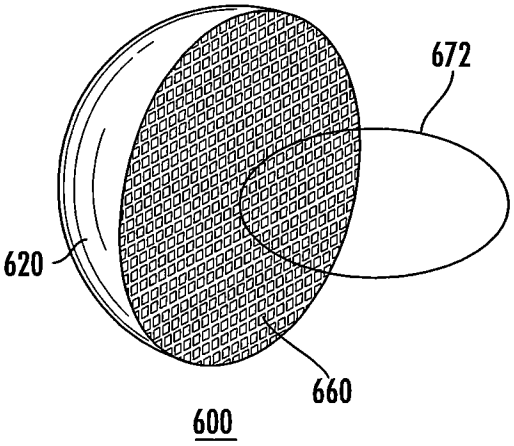
FIG. 7A is a schematic front perspective view of a microwave antenna system according to yet additional embodiments of the present invention that includes a removable microwave lens.

FIG. 7A is a perspective view of a microwave antenna system 600 in accordance with yet another embodiment of the disclosure, in a first operating state. FIG. 7B is a perspective view of the microwave antenna system 600 of FIG. 7A in a second operating state. Antenna system 600 comprises a reflector 620 and removable microwave lens 660. A microwave lens, similar to an optical lens, is a structure that refracts microwave radiation passing through it to either converge (focus) or diverge (defocus) that radiation. Microwave lens 660 may be, for example, made from (i) a suitably refractive dielectric material having a thickness that varies as a function of distance from its center, (ii) a dielectric material whose refractive index suitably varies as a function of distance from its center, (iii) a metallic structure that may be printed on a substrate, (iv) a plurality of layers of metallic structures, or (v) a combination of the above.

Figure 8B:
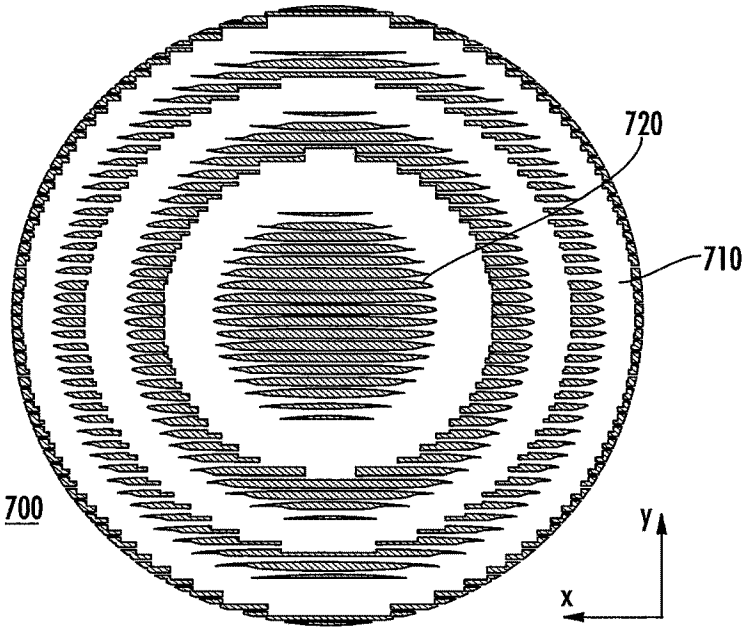
FIG. 8B is a schematic rear view of the microwave lens of FIG. 8A.
Figure 8A:
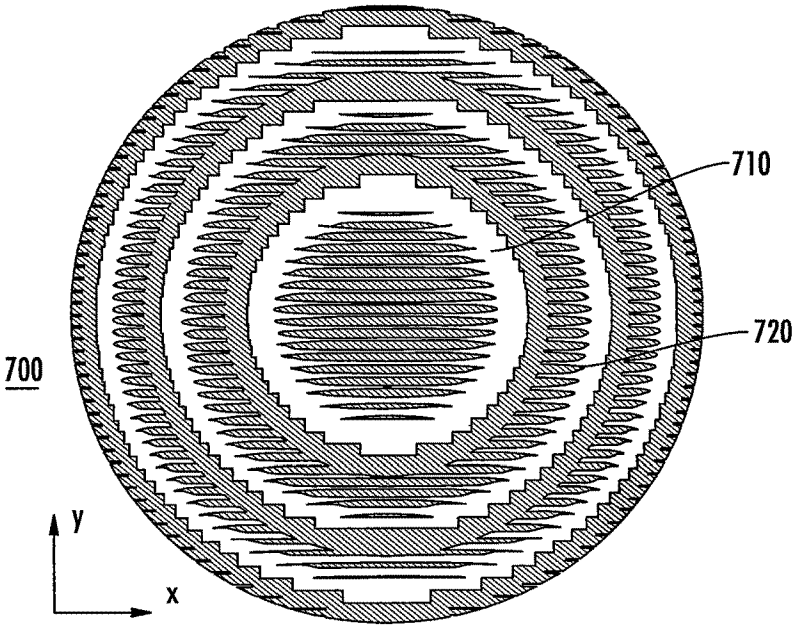
FIG. 8A is a schematic front view of a microwave lens that may be used in the microwave antenna system of FIGS. 7A-7B.

FIG. 8A is a front view of an exemplary microwave lens 700. FIG. 8B is a back view of the lens 700 of FIG. 8A. Lens 700 comprises multiple adjacent layers comprising dielectric material 710 and metallic material 720.

In the first operating state, lens 660 of FIG. 7A works like a concave lens to diverge the signal generated by antenna system 600 and produce a relatively wide beam 672. In the second operating state, the lens 660 is removed and, consequently, since there is no lens defocusing the signal, antenna system 600 generates a relatively narrow beam 674.

In some alternative embodiments of antenna system 600, the lens 660 is a polarized lens that affects only radiation polarized in a particular direction. In one implementation, the antenna system 600 generates a signal polarized in the first direction and the lens 660 is rotated or repositioned to generate either a narrow beam—when the lens 660 does not significantly affect the signal generated—or a wide beam—when the lens 660 diverges the signal generated. In another implementations, the lens 660 remains stationary and in place, but the antenna system 600 is configured to generate one of two differently polarized signals, where one is not significantly affected by the lens 660 and the other is refracted to diverge by the lens 660.

Figure 9B:
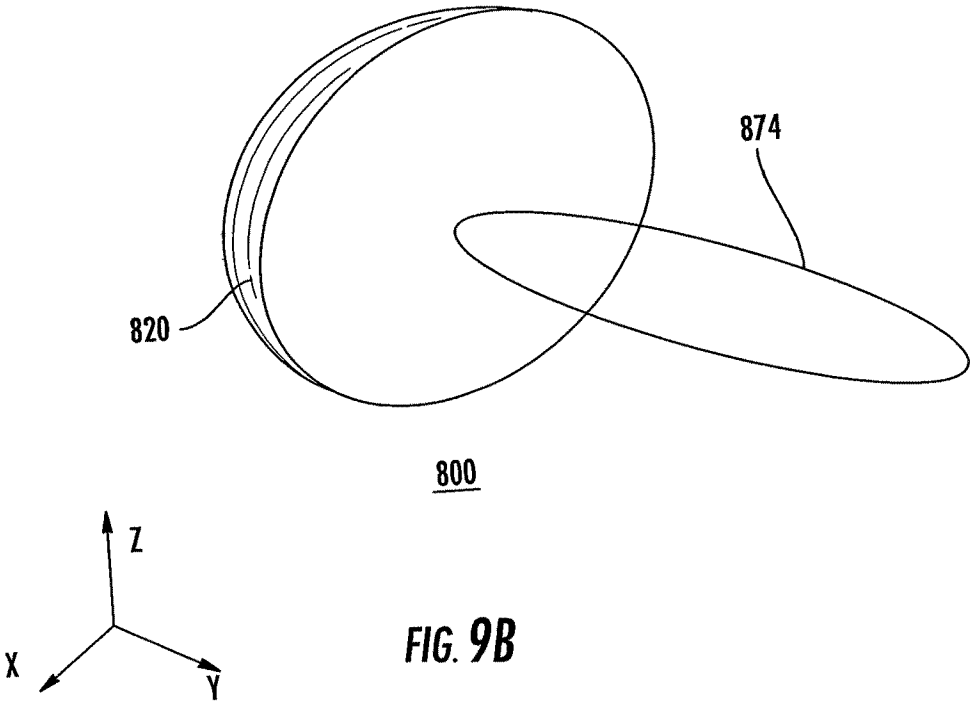
FIG. 9B is a schematic front perspective view of the microwave antenna system of FIG. 9A where the elliptical reflector is positioned in a second orientation.
Figure 9A:
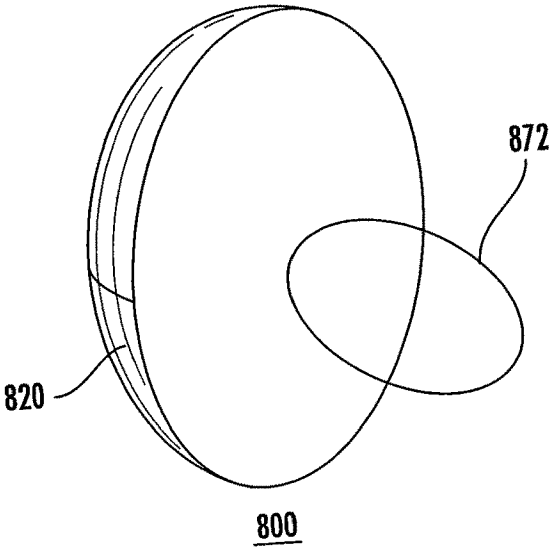
FIG. 9A is a schematic front perspective view of a microwave antenna system according to embodiments of the present invention that includes an elliptical reflector positioned in a first orientation.

FIG. 9A is a perspective view of a microwave antenna system 800 in accordance with yet another embodiment of the disclosure, in a first operating state. FIG. 9B is a perspective view of the microwave antenna system 800 of FIG. 9A in a second operating state. The microwave antenna system 800 comprises a rotatable/repositionable elliptical reflector 820. In the first operating state, as shown in FIG. 9A, the reflector 820 is oriented so that the minor axis of the reflector 820 is parallel with the azimuth—xy—plane and the major axis is parallel to the elevation—yz—plane. As a result, the beam width of the resultant beam 872 is relatively wide on the azimuth plane and relatively narrow on the elevation plane, facilitating the alignment on the elevation plane. In the second operating state, as shown in FIG. 9B, the reflector 820 has been rotated and/or repositioned by 90 degrees so that the major axis of the reflector 820 is parallel with the azimuth—xy—plane and the minor axis of the reflector 820 is parallel with the elevation—yz—plane. Consequently, the beam width of the resultant beam 874 is relatively narrow on the azimuth plane and relatively wide on the elevation plane, facilitating alignment on the azimuth plane.

It should be noted that, in alternative implementations, the orientations of the signals (not shown) generated by the antenna system 800 may be polarized vertically, horizontally, or in any other suitable direction. It should also be noted that, in alternative implementations, the reflector 820 may have a non-circular shape other than elliptical where, depending on orientation, beams of different widths would result from the same signal.

Figure 10:
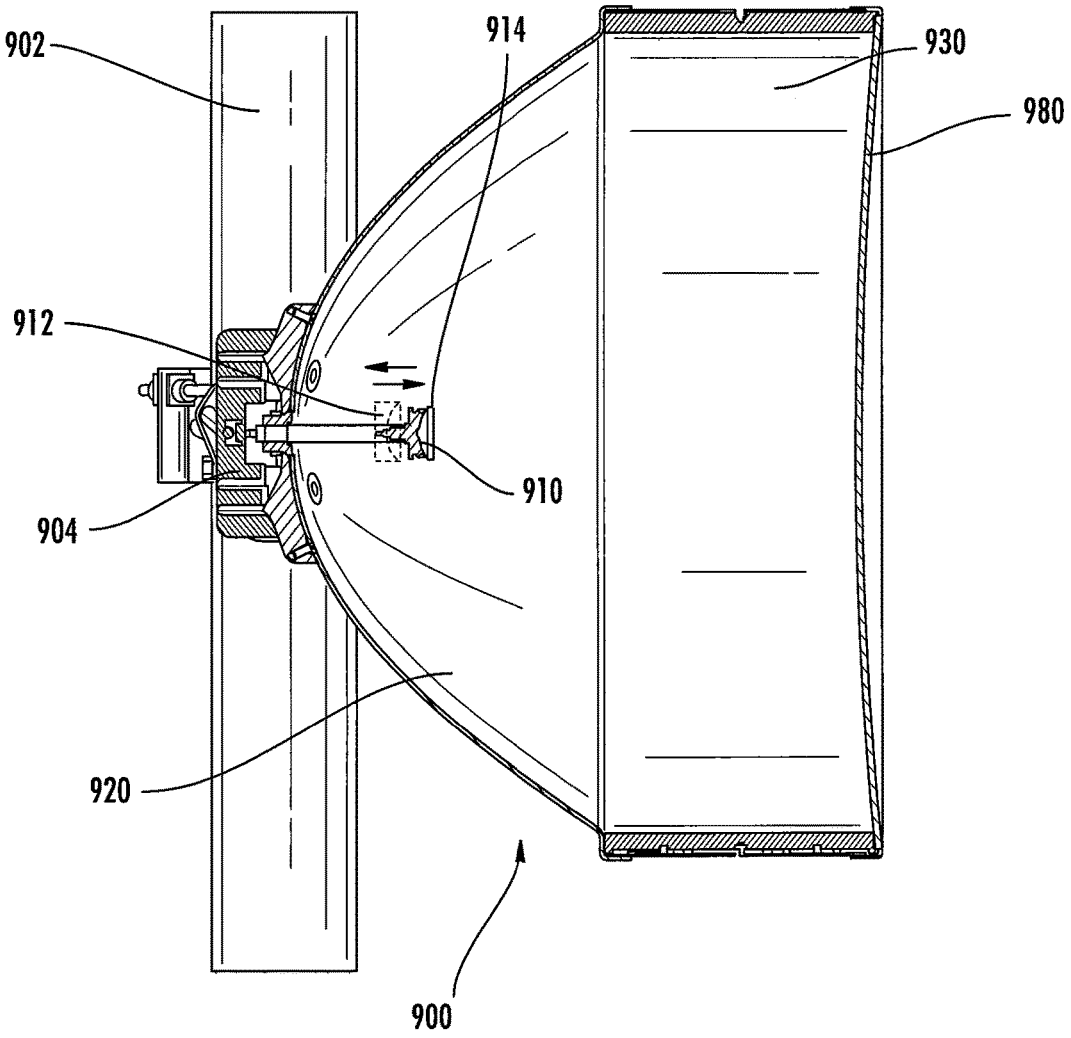
FIG. 10 is a side view of a microwave antenna system according to still further embodiments of the present invention that includes a laterally moveable feed.

FIG. 10 is a side cross-sectional view of a microwave antenna system 900, in accordance with yet another embodiment of the disclosure, mounted on pole 902. The microwave antenna system 900 comprises parabolic reflector 920, feed 910, shield 930, radome 980, and mounting module 904, which mounts the microwave antenna system 900 onto the pole 902. Feed 910 is laterally movable along the axis of symmetry of the reflector 920. In a first operating state, feed 910, shown in dashed lines, is located at a first position 912 that is away from the focus of reflector 920. As a result, the beam width of the resultant beam (not shown) is relatively wide. In a second operating state, feed 910 is located in a second position 914 that corresponds to the focus of the reflector 920. As a result, the beam width of the resultant beam (not shown) is relatively narrow. The feed 910 may be set at a particular distance from the vertex of reflector 920 in position 912 and/or 914 using a spacer. Note that, in alternative implementations, the unfocused position for the first operating state may be away from the vertex of the reflector 920 rather than towards the vertex.

Figure 11A:
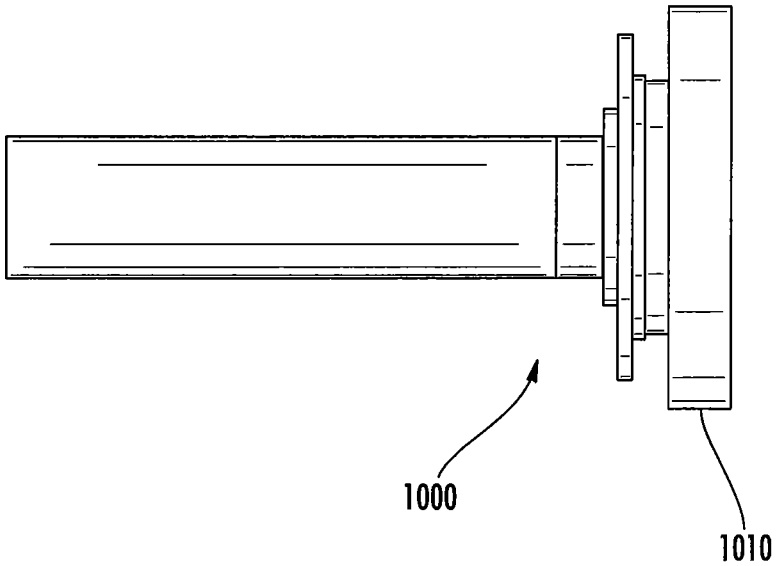
FIG. 11A is a schematic side view of a feed for a microwave antenna system according to embodiments of the present invention that includes a blinker.
Figure 11B:
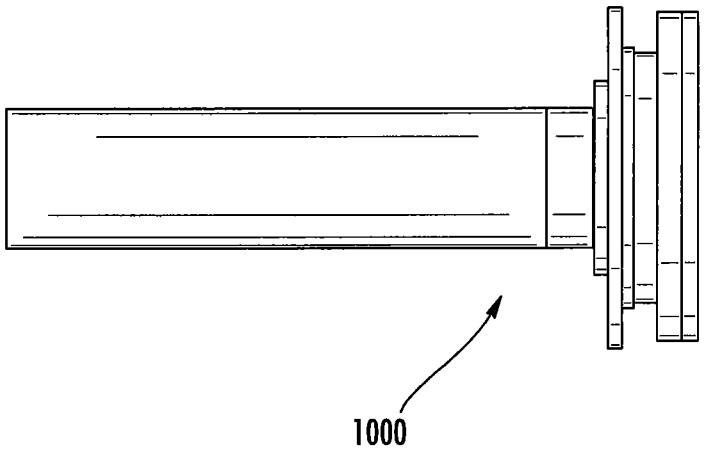
FIG. 11B is a side view of the feed of FIG. 11A with the blinker removed.

FIG. 11A is a side view of an antenna feed 1000, in accordance with yet another embodiment of the disclosure, in a first operating state. FIG. 11B is a side view of the antenna feed 1000 of FIG. 11A, in a second operating state. Antenna feed 1000 may be substantially similar to the feed 910 of antenna system 900 of FIG. 10, but may have its end fixed at the focus of the corresponding reflector (not shown) and not movable like feed 910. In the first operating state, as shown in FIG. 11A, a blinker 1010 is placed over the end of feed 1000, thereby under-illuminating the reflector and consequently producing a beam (not shown) having a relatively wide beam width. The blinker 1010 may be an annular device comprising metal and/or a microwave-absorbent material. In the second operating state, as shown in FIG. 11B, the blinker 1010 is removed, thereby allowing full illumination of the reflector and consequently producing a beam (not shown) having a relatively narrow beam width.

Figure 12A:
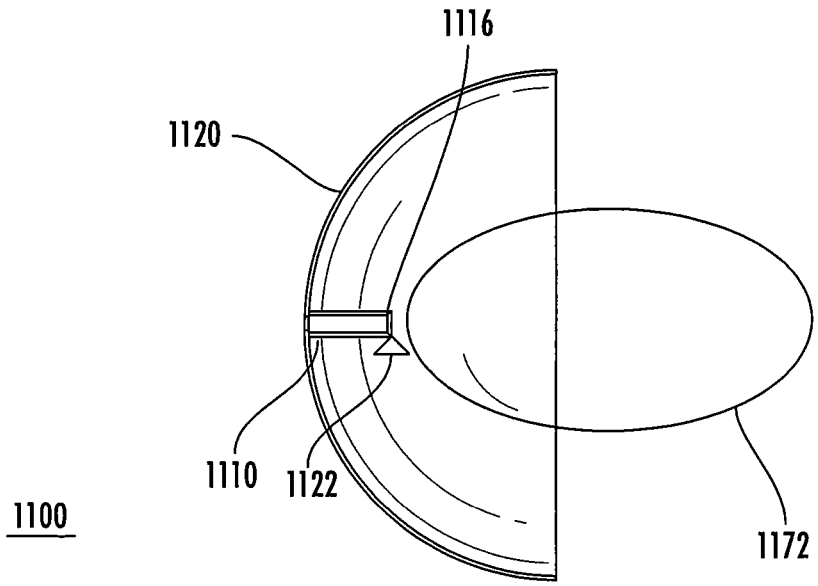
FIG. 12A is a schematic side view of a microwave antenna system according to further embodiments of the present invention that includes a repositionable sub-reflector.
Figure 12B:
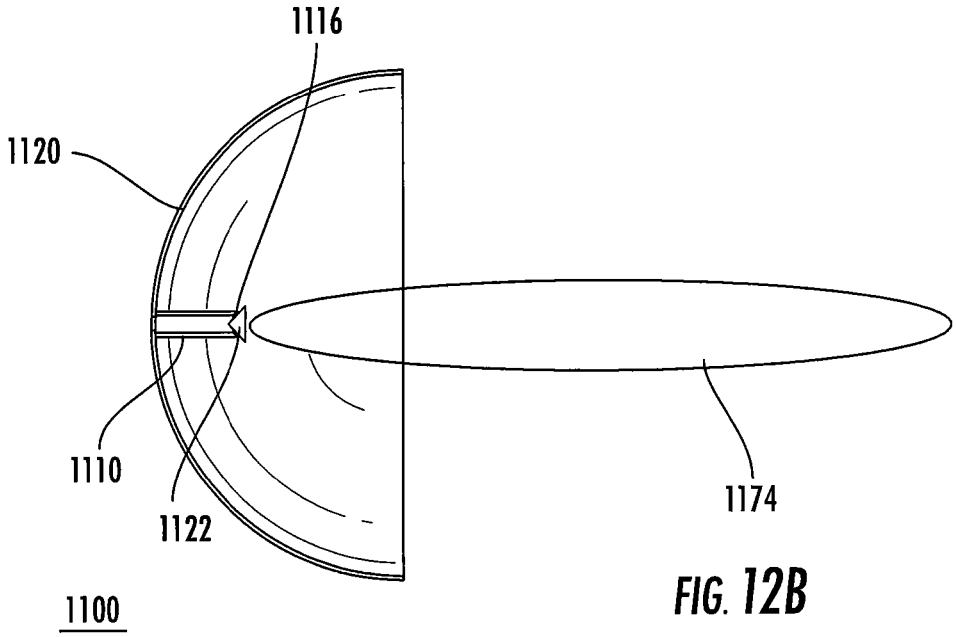
FIG. 12B is a schematic side view of the microwave antenna system of FIG. 12A with the repositionable sub-reflector in a different position.

FIG. 12A is a side cross-sectional view of a microwave antenna system 1100 in accordance with yet another embodiment of the disclosure, in a first operating state. FIG. 12B is a side cross-sectional view of the microwave antenna system 1100 of FIG. 12A in a second operating state. The microwave antenna system 1100 comprises reflector 1120, feed waveguide tube 1110 having a mouth 1116, and removable/repositionable feed sub-reflector 1122. In the first operating state, depicted in FIG. 12A, the feed sub-reflector 1122 is positioned away from the mouth 1116 so that the signal transmitted by the waveguide tube 1110 is projected from the mouth 1116 with little or no interaction with either the sub-reflector 1122 or the reflector 1120, thereby generating a relatively wide beam 1172. In the second operating state, depicted in FIG. 12B, the sub-reflector 1122 is positioned atop the mouth 1116 so that the signal transmitted by the waveguide tube 1110 is reflected by the sub-reflector 1122, located substantially at the focus of reflector 1120, onto the reflector 1120 and then out of antenna system 1100 to generate the relatively narrow beam 1174.

Embodiments of the disclosure have been described that use ring-shaped grilles as polarizing rings, where the polarizing ring allows passage of microwaves oriented in one direction and blocks passage of microwaves oriented in any other direction. It should be noted, however, that polarizing rings are not limited to metallic grilles. In some alternative embodiments, an alternative polarizing ring may be used, which polarizes microwaves by means other than parallel metal lines.

Embodiments of the disclosure have been described where the antennas are generating signals for transmission. It should be noted, however, that the embodiments are equally applicable for receiving antennas, which may similarly operate in two states for reception, where the antenna has a wide-beam reception in a first operating state and a narrow-beam reception in a second operating state.

Embodiments of the present invention have been described above with reference to the accompanying drawings, in which embodiments of the invention are shown. This invention may, however, be embodied in many different forms and should not be construed as limited to the embodiments set forth herein. Rather, the embodiments disclosed above are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" or "connected to" another element, it can be directly on or connected to the other element or intervening elements may also be present. In contrast, when an element is referred to as being "directly on" or "directly connected to" another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A method of operating a microwave antenna system that includes a microwave antenna, wherein the microwave antenna comprises a reflector and a polarizer attached to the reflector, wherein the polarizer has a polarization region and a central opening, and wherein the polarization region of the polarizer is configured to pass signals having a first polarization when the polarizer is oriented in a first orientation and is configured to block signals having the first polarization when the polarizer is oriented in a second orientation, the method comprising:

operating the microwave antenna in a first operating state during an alignment operation for the microwave antenna system where the microwave antenna is configured to have a first beam width, wherein operating the microwave antenna in the first operating state comprises transmitting a first signal having the first polarization; and operating the microwave antenna subsequent to the alignment operation in a second operating state where the microwave antenna is configured to have a second beam width that is narrower than the first beam width, wherein operating the microwave antenna in the second operating state comprises rotating the polarizer from the first orientation to the second orientation and transmitting a second signal having the first polarization.

2. The method of claim 1, wherein the first beam width corresponds to a beam width of a signal transmitted through the central opening of the polarizer.

3. The method of claim 1, wherein a pointing direction of the microwave antenna while operating in the first operating state is the same as a pointing direction of the microwave antenna while operating in the second operating state, and a frequency of the first signal is the same as a frequency of the second signal.

4. The method of claim 1, wherein the polarizer comprises metal lines printed on a microwave-permeable substrate.

5. The method of claim 1, wherein the polarizer comprises metal lines suspended between corresponding attachment endpoints in rings corresponding to an outer perimeter and an inner perimeter.

6. A method of operating a microwave antenna system that includes a microwave antenna, the method comprising:

operating the microwave antenna in a first operating state during an alignment operation for the microwave antenna system where the microwave antenna is configured to have a first beam width; and operating the microwave antenna subsequent to the alignment operation in a second operating state where the microwave antenna is configured to have a second beam width that is narrower than the first beam width, wherein the microwave antenna system comprises the microwave antenna and a removable microwave lens, wherein the removable microwave lens is mounted on the microwave antenna when the microwave antenna is operating in the first operating state and is removed from the microwave antenna when the microwave antenna is operating in the second operating state.

7. The method of claim 6, wherein a pointing direction of the microwave antenna while operating in the first operating state is the same as a pointing direction of the microwave antenna while operating in the second operating state, and a frequency of a signal transmitted in the first operating state is the same as a frequency of a signal transmitted in the second operating state.

8. A method of operating a microwave antenna system that includes a microwave antenna, wherein the microwave antenna system comprises the microwave antenna and a removable microwave lens, the method comprising:

using the microwave antenna to generate a first antenna beam having a first beam width when the microwave antenna system is operating in a first operating state; and using the microwave antenna to generate a second antenna beam having a second beam width when the microwave antenna is operating in a second operating state, wherein the removable microwave lens is mounted on the microwave antenna when the microwave antenna is operating in the first operating state and is removed from the microwave antenna when the microwave antenna is operating in the second operating state, and wherein the second beam width is narrower than the first beam width.

9. The method of claim 8, wherein a pointing direction of the microwave antenna while operating in the first operating state is the same as a pointing direction of the microwave antenna while operating in the second operating state, and a frequency of a signal transmitted in the first operating state is the same as a frequency of a signal transmitted in the second operating state.

* * * * *